US008240895B2

(12) United States Patent
Lin et al.

(10) Patent No.: US 8,240,895 B2
(45) Date of Patent: Aug. 14, 2012

(54) LIGHT FIXTURE

(75) Inventors: Hou-Yao Lin, Taipei Hsien (TW); Sheng-Jung Yu, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 262 days.

(21) Appl. No.: 12/699,907

(22) Filed: Feb. 4, 2010

(65) Prior Publication Data

US 2011/0019419 A1 Jan. 27, 2011

(30) Foreign Application Priority Data

Jul. 23, 2009 (CN) ..... 2009 1 0304736

(51) Int. Cl.
*F21S 6/00* (2006.01)
*F21V 21/26* (2006.01)

(52) U.S. Cl. ..... 362/418; 362/431; 362/285; 362/427

(58) Field of Classification Search ..... 362/418, 362/431, 269, 35, 285, 287, 427, 432, 388
See application file for complete search history.

(56) References Cited

U.S. PATENT DOCUMENTS

| | | | | |
|---|---|---|---|---|
| 4,726,552 | A * | 2/1988 | Warshawsky | 248/122.1 |
| 5,997,151 | A * | 12/1999 | Douglass, II | 362/239 |
| 7,665,862 | B2 * | 2/2010 | Villard | 362/249.02 |
| 2007/0097689 | A1 * | 5/2007 | Barausky et al. | 362/287 |
| 2008/0089071 | A1 * | 4/2008 | Wang | 362/294 |

* cited by examiner

*Primary Examiner* — Peggy A. Neils
(74) *Attorney, Agent, or Firm* — Altis Law Group, Inc.

(57) ABSTRACT

An LED light fixture includes a post having a fixing bar at a top end thereof, a first lamp mounted on the fixing bar, and a second lamp rotatably mounted on the fixing bar. The first and second lamps are capable of rotating with respect to the fixing bar to change an angle between the first and second lamps, to thereby change an illumination area and intensity distribution of the LED light fixture. In one position, the second lamp overlaps the first lamp, and LED light sources in the first lamp are alternate with those of the second lamp.

14 Claims, 4 Drawing Sheets

LIGHT FIXTURE

BACKGROUND

1. Technical Field

The present disclosure relates generally to a light fixture, and more particularly to a light fixture using solid state light emitters, e.g., light emitting diodes (LEDs) as a light source, wherein the light fixture is versatile regarding the illuminating area and intensity.

2. Description of Related Art

LED lamp, a solid-state lighting, utilizes LEDs as a source of illumination, providing advantages such as resistance to shock and nearly limitless lifetime under specific conditions. Thus, LED lamps present a cost-effective yet high quality replacement for incandescent and fluorescent lamps.

A typical LED lamp is fixed onto a post and only illuminate at a given direction. In addition, the LED lamp provides a constant brightness at the given direction. This type of LED lamp fails to meet a requirement of an adjustable illumination direction or brightness.

What is need therefore is a light fixture which can overcome the above limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
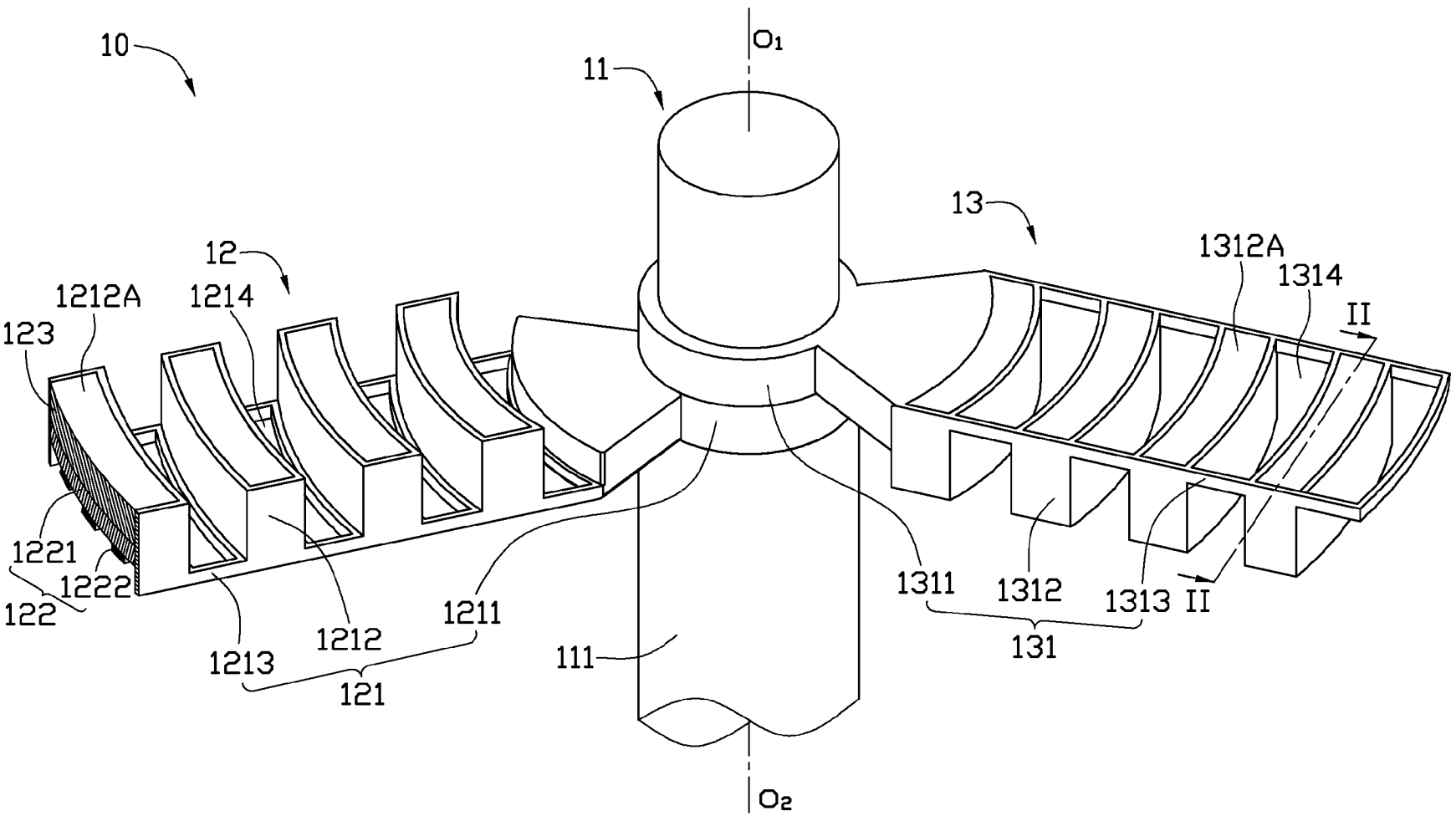
FIG. 1 is an isometric, assembled view of a light fixture in accordance with a first embodiment of the present disclosure, with a part thereof being cut away for clarity.

A light fixture of the present disclosure can be applied in roadways, plazas, parks or other places needing illumination. As shown in FIG. 1, the light fixture 10 in accordance with a first embodiment of the present disclosure comprises a post 11, a first lamp 12 and a second lamp 13 both mounted on the post 11. The post 11 has a columned fixing bar 111 at a top end thereof. The first and second lamps 12, 13 are rotatably mounted on the fixing bar 111.

The first lamp 12 comprises a first frame 121, a plurality of first light sources 122, and a plurality of first heat sinks 123. The first light sources 122 are spaced from each other and received in the first frame 121. The first heat sinks 123 each are thermally connected to a corresponding first light source 122.

The first frame 121 has a substantially rectangular shape and is preferably made of metallic material. The first frame 121 comprises a first sleeve 1211, and a plurality of first supporting parts 1212 and first hollow parts 1213 extending horizontally from the first sleeve 1211 in a first predetermined direction. The first sleeve 1211 is rotatably mounted on the fixing bar 111 and the first lamp 12 is capable of rotating in the horizontal plane with respect to a central axis $O_1O_2$ of the fixing bar 111. There are four first supporting parts 1212 and four first hollow parts 1213 in this embodiment. It is noted that, the numbers of the first supporting parts 1212 and the first hollow parts 1213 can be changed in other embodiments, such as only one first supporting part 1212 and one first hollow part 1213 in an alternative embodiment. The first supporting parts 1212 and the first hollow parts 1213 are alternately arranged along an elongated direction of the first frame 121, i.e., a radial direction of the light fixture. That is, each one of the first hollow parts 1213 is located between two adjacent first supporting parts 1212, excepting the one connecting to the first sleeve 1211. It is to be understood that, in alternative embodiments, an additional first supporting part 1212 can be provided to connect with the first sleeve 1211. In this way, every one of the first hollow parts 1213 is located between two adjacent first supporting parts 1212. The first supporting parts 1212 and the first hollow parts 1213 each have a shape of an arc in a top plan view thereof, and the first supporting parts 1212 are concentric with the first hollow parts 1213, each with a center thereof locating on the axis $O_1O_2$ of the fixing bar 111. The first hollow parts 1213 each define a window 1214 therein. The first supporting parts 1212 each form a sidewall which defines a first receiving room 1212A for receiving a corresponding first light source 122 and a corresponding first heat sink 123 therein.

The first light sources 122 each comprise a first base 1221 and a plurality of first light emitting elements 1222 mounted on a bottom of the first base 1221. In this embodiment, the first light emitting elements 1222 are LEDs. The first light emitting elements 1222 face downwardly to allow light generated therefrom to radiate downwards through the first receiving room 1212A to lighten an object needing illumination. The first heat sink 123 is disposed on the first base 1221 of the first light source 122 to dissipate heat generated by the first light source 122.

The second lamp 13 comprises a second frame 131, a plurality of second light sources 132 spaced from each other and received in the second frame 131, and a plurality of second heat sinks 133 each thermally connected to a corresponding second light source 132.

The second frame 131 has a substantially rectangular shape and is preferably made of metallic material. The second frame 131 comprises a second sleeve 1311, and a plurality of second supporting parts 1312 and second hollow parts 1313 extending horizontally from the second sleeve 1311 in a second predetermined direction which is different from the first predetermined direction. The second sleeve 1311 is rotatably mounted on the fixing bar 111 and located on the first sleeve 1211 of the first lamp 12. The second lamp 13 is capable of rotating in the horizontal plane with respect to the center axis $O_1O_2$ of the fixing bar 111 to change the angle between the first and second lamps 12, 13. The second supporting parts 1312 and the second hollow parts 1313 are alternately arranged. One of the second supporting parts 1312 connects to the second sleeve 1311 in this embodiment. It is to be understood that, in alternative embodiments, an additional second hollow part 1313 can be provided to connect with the second sleeve 1311. Further, there are four second supporting parts 1312 and four second hollow parts 1313 in this embodiment. Of course the numbers of the second supporting parts 1312 and second hollow parts 1313 can be changed in other embodiments, such as only one of the second supporting parts 1312 and one of the second hollow parts 1313 in an alternative embodiment. The second supporting parts 1312 and the second hollow parts 1313 each have a shape of an arc in a top plan view thereof, and the second supporting parts 1312 are concentric with the second hollow parts 1313, each with a center thereof locating on the axis $O_1O_2$ of the fixing bar 111. The second hollow parts 1313 each define a window 1314 therein. The second supporting parts 1312 each form a sidewall, which defines a second receiving room 1312A for receiving a corresponding second light source 132 and a corresponding second heat sink 133 therein.

Figure 2:
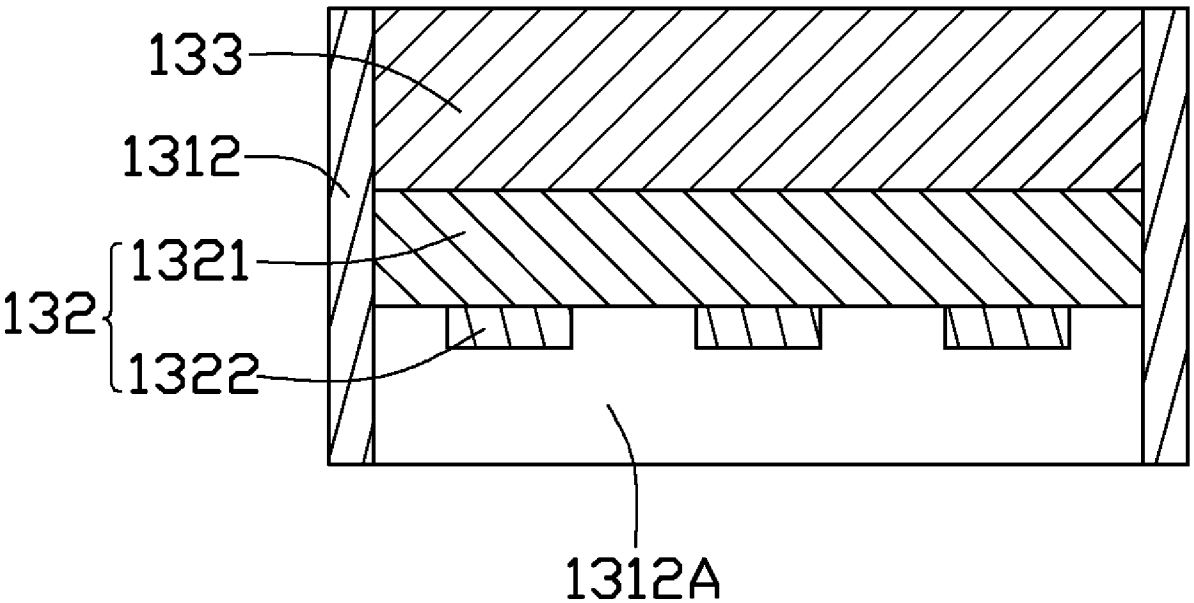
FIG. 2 is a cross-sectional view of the light fixture in FIG. 1, taken along line II-II thereof.

Referring to FIG. 2, the second light sources 132 each comprise a second base 1321 and a plurality of second light emitting elements 1322 mounted on a bottom of the second base 1321. In this embodiment, the second light emitting elements 1322 are LEDs. The second light emitting elements 1322 face to an opening of the second receiving room 1312A to allow light generated therefrom projecting downwardly and out of the second receiving room 1312A. The second heat sink 133 is disposed on the second base 1321 of the second light source 132 to dissipate heat generated by the second light source 132.

Figure 3:
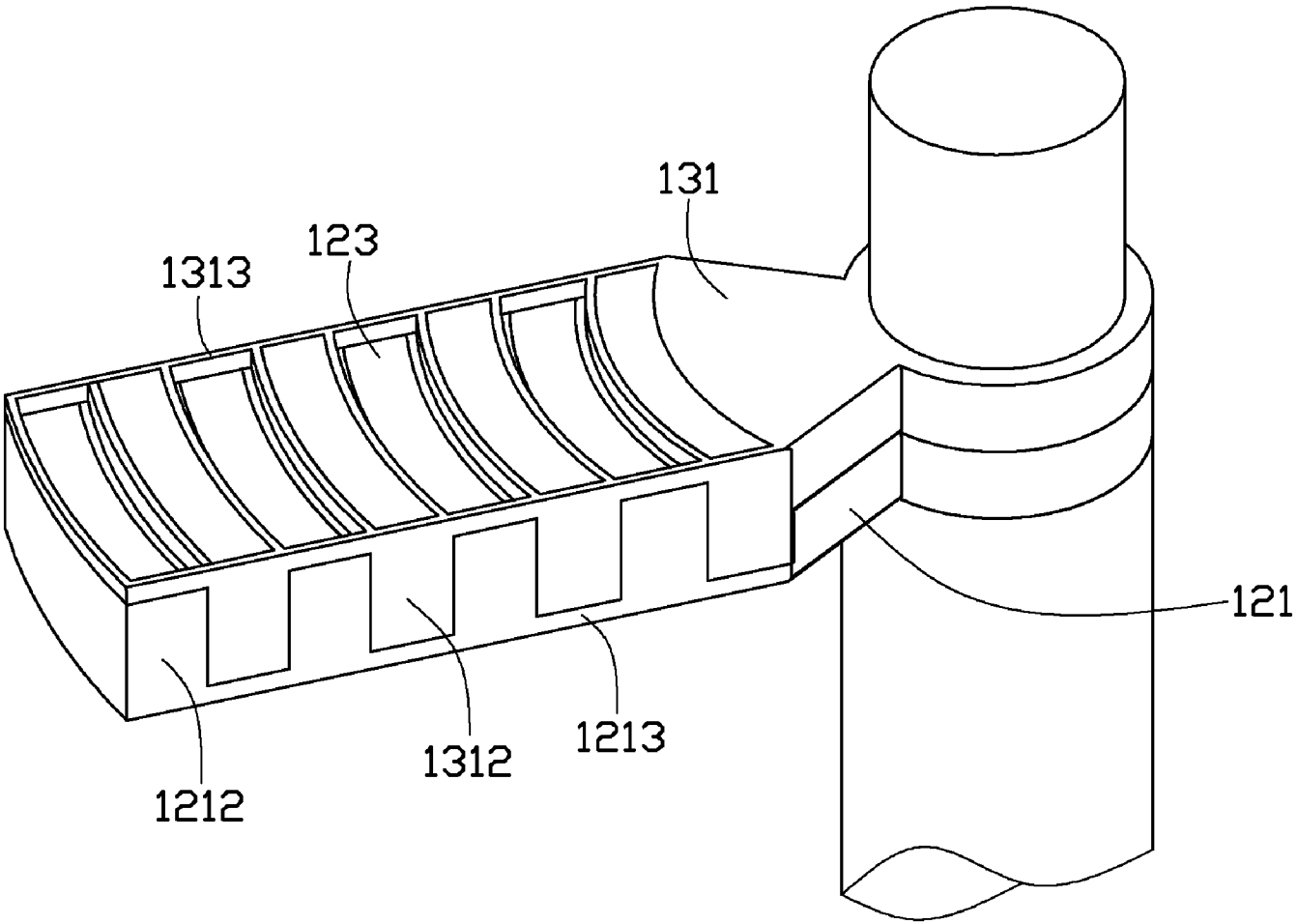
FIG. 3 is an isometric, assembled view of the light fixture in FIG. 1, shown in a different status.

The first and second lamps 12, 13 are capable of rotating with respect to the fixing bar 111, whereby the first and second lamps 12, 13 can be oriented toward different directions or a same direction so that the light fixture 10 can be used to meet different requirements. As shown in FIG. 3, the second lamp 13 is rotated to be oriented toward the first predetermined direction and fitly engaged with the first lamp 12 to increase a brightness in that direction. Specifically, the second supporting parts 1312 of the second lamp 13 are respectively located on the first hollow parts 1213 of the first lamp 12, and the second hollow parts 1313 of the second lamp 13 are respectively located on the first supporting parts 1212 of the first lamp 12. Since the first and second supporting (hollow) parts 1212, 1312 (1213, 1313) of the first and second lamps 12, 13 are configured to be arc-shaped and have similar sizes, each second supporting part 1312 of the second lamp 13 can be fitly engaged between two corresponding adjacent first supporting parts 1212 of the first lamp 12.

Figure 4:
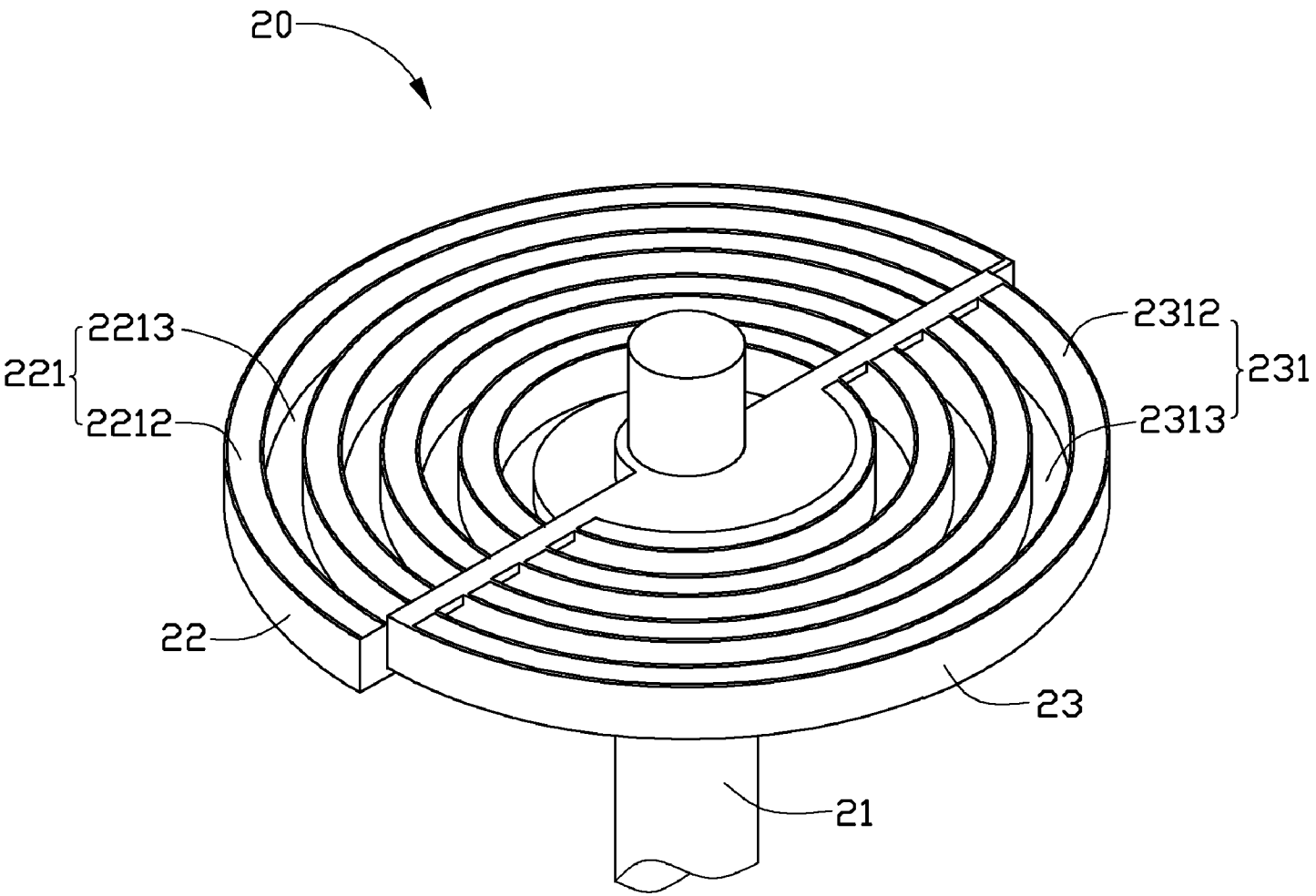
FIG. 4 is an isometric, assembled view of a light fixture in accordance with a second embodiment of the present disclosure.

A circumferential length of the supporting (hollow) parts of the lamps can be changed as desired. FIG. 4 shows a light fixture 20 in accordance with a second embodiment of the present disclosure. Similar to the light fixture 10 of the first embodiment, the light fixture 20 also comprises a post 21, a first lamp 22 and a second lamp 23 both rotatably mounted on the post 21. The difference between the light fixtures 10, 20 is that, first and second frames 221, 231 of the first and second lamps 22, 23 of the light fixture 20 each have a substantially semicircular shape. Specifically, the first frame 221 of the first lamp 22 comprises four semicircular first supporting parts 2212 and four semicircular first hollow parts 2213. The first supporting parts 2212 and the first hollow parts 2213 are alternately arranged. The second frame 231 of the second lamp 23 comprises four semicircular second supporting parts 2312 and four semicircular second hollow parts 2313. The second supporting parts 2312 and the second hollow parts 2313 are alternately arranged.

When the first and second lamps 22, 23 are disengaged with each other, as shown in FIG. 4, the first and second lamps 22, 23 form a substantially round lamp with light sources received in the first and second supporting parts 2212, 2312. Since the first and second lamps 22, 23 are capable of rotating with respect to the post 21, the first lamp 22 can be fitly engaged with the second lamp 23, with each second supporting part 2312 of the second lamp 23 fitly received between two corresponding adjacent first supporting parts 2212 of the first lamp 22.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A light fixture comprising:

a post;

a first lamp comprising a first frame rotatably mounted on the post and a plurality of first light sources, the first frame comprising a plurality of first supporting parts and first hollow parts being alternately arranged, the first light sources received in the first supporting parts, respectively; and a second lamp comprising a second frame rotatably mounted on the post and a plurality of second light sources, the second frame comprising a plurality of second supporting parts and second hollow parts being alternately arranged, the second light sources received in the second supporting parts, respectively;

wherein the first lamp and the second lamp are rotatable to be aligned with each other, in which the second supporting parts are located over the first hollow parts, the second hollow parts are located over the first supporting parts, and each second supporting part is fitly engaged between two corresponding adjacent first supporting parts.

2. The light fixture of claim 1, wherein the first frame further comprises a first sleeve mounted on the post, a corresponding first hollow part extending from the first sleeve, and the second frame further comprises a second sleeve mounted on the post and located on the first sleeve, a corresponding second supporting part extending from the second sleeve.

3. The light fixture of claim 1, wherein the first lamp further comprises a plurality of first heat sinks thermally connected to the first light sources, respectively, and the second lamp further comprises a plurality of second heat sinks thermally connected to the second light sources, respectively.

4. The light fixture of claim 3, wherein each first supporting part defines a first receiving room for receiving a corresponding first light source and a corresponding first heat sink, and each second supporting part defines a second receiving room for receiving a corresponding second light source and a corresponding second heat sink.

5. The light fixture of claim 1, wherein each of the first and second frames has a shape of a semicircular.

6. The light fixture of claim 1, wherein each of the first and second frames has an elongated shape.

7. The light fixture of claim 1, wherein each of the first supporting and hollow parts and second supporting and hollow parts has an arc-shaped configuration.

8. A light fixture comprising:

a post having a fixing bar at a top end thereof;

a first lamp mounted on the fixing bar; and a second lamp rotatably mounted on the fixing bar and being capable of rotating with respect to the fixing bar to change an angle between the first and second lamps;

wherein the first lamp comprises a first frame and a plurality of first light sources spaced from each other and received in the first frame, and the second lamp comprises a second frame and a plurality of second light sources spaced from each other and received in the second frame; and wherein the first frame comprises a first sleeve mounted on the fixing bar, and a plurality of first supporting parts and first hollow parts extending from the first sleeve, the first light sources respectively received in the first supporting parts, the first supporting parts and the first hollow parts being alternately arranged, and the second frame comprises a second sleeve mounted on the fixing bar and located on the first sleeve, and a plurality of second supporting parts and second hollow parts extending from the second sleeve, the second light sources respectively received in the second supporting parts, the second supporting parts and the second hollow parts being alternately arranged.

9. The light fixture of claim 8, wherein the first supporting parts each comprise an upward extending sidewall receiving a corresponding first light source therein, and the second supporting parts each comprise a downward extending sidewall receiving a corresponding second light source therein.

10. The light fixture of claim 9, wherein the first lamp further comprises a plurality of first heat sinks respectively received in the first supporting parts and respectively connected to the first light sources, and the second lamp further comprises a plurality of second heat sinks respectively received in the second supporting parts and respectively connected to the second light sources.

11. The light fixture of claim 9, wherein the first hollow parts each define a window therein, and the second hollow parts each define a window therein.

12. The light fixture of claim 11, wherein the second hollow parts are respectively located on the first supporting parts and the second supporting parts are respectively located on the first hollow parts, when the second lamp is rotated to be oriented at a same direction and aligned with the first lamp.

13. The light fixture of claim 12, wherein the second supporting parts each are fitly sandwiched between two adjacent first supporting parts, and light generated by the second light sources projects through the windows of the first hollow parts when the second lamp is rotated to be oriented at a same direction and aligned with the first lamp.

14. The light fixture of claim 8, wherein the first and second light sources each comprise a base and a plurality of LEDs mounted on the base.

* * * * *